US006318579B1

(12) United States Patent
Leess

(10) Patent No.: US 6,318,579 B1
(45) Date of Patent: Nov. 20, 2001

(54) ROLL-TOP TRASH CAN

(76) Inventor: Lynelle S. Leess, 148 Hardscrabble Lake Dr., Chappaqua, NY (US) 10514

( * ) Notice: Subject to any disclaimer, the term of this patent is extended or adjusted under 35 U.S.C. 154(b) by 0 days.

(21) Appl. No.: 09/624,592

(22) Filed: Jul. 25, 2000

(51) Int. Cl.[7] ..... B65D 43/20

(52) U.S. Cl. ..... 220/345.2; 220/351; 220/345.4; 220/908

(58) Field of Search ..... 220/345.2, 345.1, 220/345.3, 345.4, 348, 349, 213, 324, 326, 908, 812, 815, 350, 351, 252; 206/816; 217/62

(56) References Cited

U.S. PATENT DOCUMENTS

| | | | | |
|---|---|---|---|---|
| 2,606,652 | | 8/1952 | Jaquette et al. . | |
| 2,650,699 | | 9/1953 | Donovan . | |
| 2,661,119 | * | 12/1953 | Spiess, Jr. et al. | 220/815 |
| 2,739,730 | | 3/1956 | Jonas . | |
| 2,921,710 | * | 1/1960 | Hutterer | 220/213 |
| 3,687,328 | * | 8/1972 | Spruyt et al. | 220/908 |
| 4,162,024 | | 7/1979 | Shanley . | |
| 4,457,444 | * | 7/1984 | Wold | 220/213 |
| 5,494,181 | * | 2/1996 | Denney | 217/62 |
| 5,555,995 | * | 9/1996 | Galer | 220/324 |
| 5,673,811 | * | 10/1997 | Dickinson et al. | 220/345.4 |
| 5,761,750 | * | 6/1998 | Mazzola et al. | 4/500 |
| 5,788,108 | * | 8/1998 | Rohr | 220/812 |
| 5,957,319 | * | 9/1999 | Shane da Costa | 220/908 |
| 6,053,354 | * | 4/2000 | Niemeyer | 220/908 |
| 6,053,591 | * | 4/2000 | Kasanic | 312/297 |

* cited by examiner

*Primary Examiner*—Nathan J. Newhouse

(57) ABSTRACT

A trash can with a sliding lid that rides in tracks facing inwardly on sides of the trash can body from an open position along a back wall of the trash can to cover and close the top of the trash can. Stops are provided for limiting the closing movement of the lid. A latching mechanism is provided for holding the lid in a closed position.

19 Claims, 2 Drawing Sheets

ROLL-TOP TRASH CAN

BACKGROUND AND SUMMARY OF THE INVENTION

The invention relates to a trash can with a roll-top lid.

Currently trash can lids come loose from the can when trashmen empty the cans. When loose, the lids can blow away or can be run over by vehicles whereby they can be damaged beyond the ability to be used to seal the can. Further, the lids can sometime pop off or be blown loose.

It is an object of this invention to produce a trash can where the lid will be retained in the trash can when the lid is opened by a trashman for emptying.

Other objects, advantages and novel features of the present invention will become apparent from the following detailed description of the invention when considered in conjunction with the accompanying drawings.

DETAILED DESCRIPTION OF THE DRAWINGS

Figure 1:
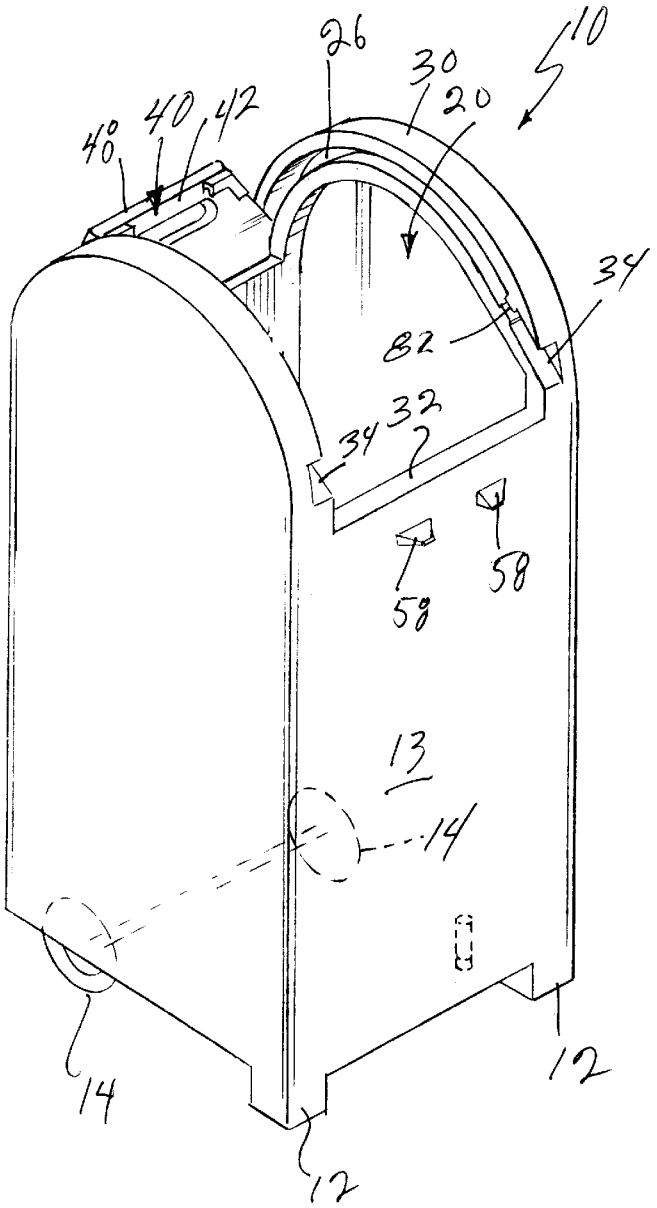
FIG. 1 shows a three dimensional view of a trash can prior to insertion of its lid.

A trash can 10 employing the invention is shown in FIG. 1. The trash can 10 has the general configuration of a U.S. Postal Service Mail Box with two legs 12 in the front side 13 and two wheels 14 adjacent the rear side 16. A handle 18 is located on the rear side 16 to allow rolling of the trash can 10 to the collection area (e.g. alley behind a house). To roll the trash can 10, one pivots (in the direction of arrow A FIG. 4) the trash can 10 about wheels 14 to lift legs 12 off the ground, so to allow one to pull the trash can 10 while it rolls on its wheels 14.

The top of the trash can 10 has an open area 20 for insertion and removal of trash. On the inside of the trash can 10 on each side wall is a recessed track 26 which runs from the bottom of the trash can at the rear side 16 upward around the curve top 30 and down the front side 13 to the front end 32 of opening 20. The track 26 is open toward the front side 13 of the trash can 10 at exit 34. The track also has an opening 36 in that portion extending along the real wall 16.

Figure 2:
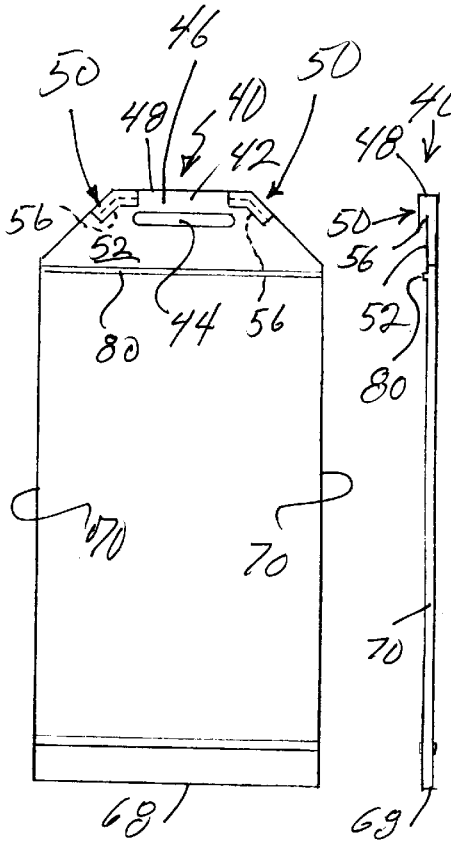
FIG. 2 shows a plan view of the lid.
Figure 3:
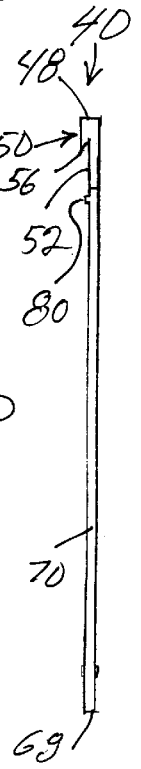
FIG. 3 shows a side view of the lid.

An flexible type lid 40 is shown in FIGS. 2 and 3. The lid 40 is generally of rectangular configuration with a pull handle portion 42 at one end 48. The pull handle portion 42 is provided with an opening 44 to define a pull bar portion 46 between the opening 44 and the one end 48. Two latch pads 50 are located on the bottom side 52 of the lid 40. The latch pads 50 have a recessed back slot 56 which cooperates with latch blocks 58 located on the front side 13 of trash can 10.

The latch blocks 58 also have a recess 60 at their lower edge 62 to cooperate with the recess 56 on the latch pads 50 on the lid 40.

To insert the lid 40 into the trash can 10, the lid is slightly rolled around its rear end 68 and inserted into open area 20 in the inside of trash can 10 so as to be parallel to the front 13 and rear walls 16. The handle portion is then lifted upwardly so the side edges 70 pass into the track 26 through opening 36 and then upwardly around the track 26 in the upper rounded sides 30 of the trash can and out the exit 34 of the track as the lid 40 is unrolled.

The track 26 has a raised stop 82 on its downward front portion at the top of front 13 of the trash can 10. The stop 82 only extends half way across the track 26 and cooperates with a stop bar 80 on the bottom side of the lid 40. The stop 82 upon engagement with the stop bar 80 thus limits the outward extension of the lid 40 through exit 34. The height of slot opening 36 above the bottom 28 of the trash can is such that when stop 82 engages, the stop bar 80 on the lid 40, the rear end 68 of the lid 40 is located below the top rear wall 16 of the trash can 10 and above the opening 36.

The lid 40 can be latched when the stop 82 engages the stop bar 80 on lid 40 by a user stretching handle portion 42 of lid 40 by pulling on the one end pull handle portion 42 slightly distorting and elongating opening 40 to allow the cooperating latch pads 50 on the lid 40 to snap over latch blocks 58 on the front side 13 of the trash can 10. Release of the pull handle 42 of the lid 40 allows recess 56 on latch pad 50 to engage recess 66 on latch block 58 to hold the lid in a closed position.

After pulling down on the pull handle portion 48 and lifting the end 42 of lid away from the front wall 13 of trash can, the user is allowed to roll the lid back down track 26 until the rear end 68 of the lid 40 hits the bottom 28 of the trash can 10. The rear end 68 of lid 40 does not come out opening 36 since the track is vertical at opening 36. Of course, if it is necessary to remove lid 40 from trash can 10, when the rear end 68 gets to opening 36 it is grasped and pulled forward through opening 36 toward the front side 13 of the trash can 10 to allow the lid to be removed by continued pulling of the lid 40 through opening 36.

Instead of using stop bar 80 and stop 82 to limit the amount the end 42 of the lid 40 can extend beyond the end of track 26, the track could be closed without an exit 34. At that point edge 70 of lid 40 would abut the front edge 90 of the track 26. The stop bar 80 configuration is the preferred version since the stop bar 80 provides lateral stability to the lid 40 to keep the lid 40 from collapsing into the trash can 10. Additional reinforcing bars 82 can be provided across the lid 40 between the bar 82 shown and the rear edge 68 of the lid, if desired.

Figures 4, 5:
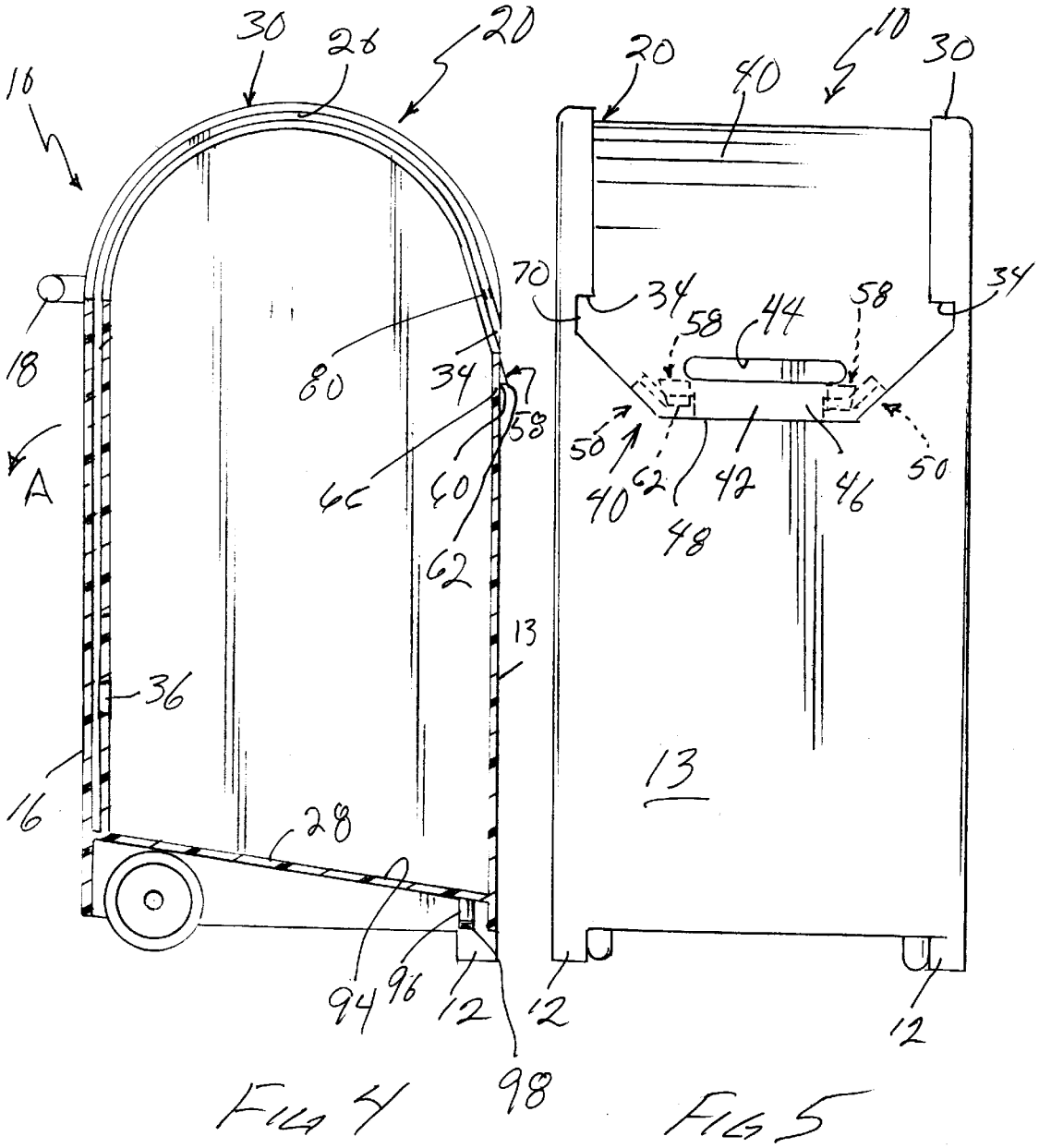
FIG. 4 is an inside view of one side of the trash can taken along line 4–4 of FIG. 1.
FIG. 5 is a front view of the trash can with the lid closed.

As shown in FIG. 4, the top 94 floor of the bottom 28 of the trash can slopes forwardly so that if any water gets into the trash can 10, it will flow toward the front side 13. A drain 96 is located at the front side of the bottom wall 28 to allow water to be drained out of the trash can 10. A plug 98 is located at the bottom of the drain 96. This drain 96 allows for washing of the inside walls of the trash can 10 with a garden hose (not shown). The plug keeps rodents out of the trash can when the trash can is in use.

The trash can 10 and lid 40 can be made of plastic. The lid 40 can be a flat sheet or made of attached segments similar to lids or roll-top desks.

Although the present invention has been described and illustrated in detail, it is to be clearly understood that the same is by way of illustration and example only, and is not to be taken by way of limitation. The spirit and scope of the present invention are to be limited only by the terns of the appended claims.

What is claimed is:

1. A trash can for holding trash comprising:

a trash can body having a front wall and a rear wall connected by two side walls to define an open refuse compartment;

a pair of tracks, one track located in each of the side walls, which tracks are open to the inside of the refuse compartment and extend vertically along the side walls adjacent the rear wall of the body and across the top of the side walls and downwardly to an opening in the side wall adjacent the top of the front wall of the body;

a sliding lid inserted into the tracks is moveable from a substantially vertical configuration residing in the vertical portion of the track adjacent the real wall of the body to slide forwardly across the track portion lying across the top of the side walls to cover the open refuge area at the top of the trash can body; and at least one stop located on the side walls of the body to engage the lid and limit its forward motion to stop the lid from being removed from the tracks in the side walls of the body.

2. The trash can of claim 1, wherein the trash can body has at least two wheels adjacent a bottom side of the rear wall to allow for easy rolling of the trash can body.

3. The trash can of claim 1, wherein the body has a bottom portion that slopes downwardly with respect to the ground on which the body rests and with a drain at its lowest edge to allow draining of any water in the body.

4. The trash can of claim 3, wherein the bottom slopes toward the front wall of the body.

5. The trash can of claim 4, wherein the trash can body has at least two wheels adjacent a bottom side of the rear wall to allow for easy rolling of the trash can body.

6. The trash can of claim 1, wherein the lid has a handle portion at one end.

7. The trash can of claim 6, wherein the trash can body has at least two wheels adjacent a bottom side of the rear wall to allow for easy rolling of the trash can body.

8. The trash can of claim 6, wherein the body has a bottom portion that slopes downwardly with respect to the ground on which the body rests and with a drain at its lowest edge to allow draining of any water in the body.

9. The trash can of claim 8, wherein the bottom slopes toward the front wall of the body.

10. The trash can of claim 6, wherein the handle portion of the lid extends past front ends of the tracks to overhang the front wall of the body.

11. The trash can of claim 10, wherein the trash can body has at least two wheels adjacent a bottom side of the rear wall to allow for easy rolling of the trash can body.

12. The trash can of claim 10, wherein the body has a bottom portion that slopes downwardly with respect to the ground on which the body rests and with a drain at its lowest edge to allow draining of any water in the body.

13. The trash can of claim 12, wherein the bottom slopes toward the front wall of the body.

14. The trash can of claim 10, wherein the front wall of the body has at least one latching block on its outside surface that cooperates with at least a single latch pad located on the overhang portion of the lid.

15. The trash can of claim 14, wherein the at least one latching block and the least a single latch pad each have a recess which engage with each other to hold the lid in its closed position covering the top of the body.

16. The trash can of claim 15, wherein the at least one latching block and the at least single latch pad snap over one another to latch the lid in its closed position.

17. The trash can of claim 16, wherein the over hang portion of the lid has an opening which can be elongated to allow the overhang lid portion to stretch so that the at least single latch pad can snap over the at least one latch block.

18. The trash can of claim 16, wherein the at least one latching block and the at least single latch pad snap over one another to latch the lid in its closed position.

19. The trash can of claim 18, wherein the over hang portion of the lid has an opening which can be elongated to allow the overhang lid portion to stretch so that the at least single latch pad can snap over the at least one latch block.

* * * * *